US010440809B2

(12) United States Patent
Yoshida et al.

(10) Patent No.: US 10,440,809 B2
(45) Date of Patent: Oct. 8, 2019

(54) ACCELERATING CAVITY AND ACCELERATOR

(71) Applicants: MITSUBISHI HEAVY INDUSTRIES MACHINERY SYSTEMS, LTD., Hyogo (JP); Inter-University Research Institute Corporation High Energy Accelerator Research Organization, Ibaraki (JP)

(72) Inventors: Mitsuhiro Yoshida, Ibaraki (JP); Daisuke Satoh, Ibaraki (JP); Nobuyuki Shigeoka, Hyogo (JP); Sadao Miura, Hyogo (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 0 days.

(21) Appl. No.: 16/065,776

(22) PCT Filed: Dec. 16, 2016

(86) PCT No.: PCT/JP2016/087683
§ 371 (c)(1),
(2) Date: Jun. 22, 2018

(87) PCT Pub. No.: WO2017/110700
PCT Pub. Date: Jun. 29, 2017

(65) Prior Publication Data

US 2019/0014653 A1 Jan. 10, 2019

(30) Foreign Application Priority Data

Dec. 25, 2015 (JP) ..... 2015-254039

(51) Int. Cl.
*H05H 7/00* (2006.01)
*H05H 7/18* (2006.01)
*H05H 9/00* (2006.01)

(52) U.S. Cl.
CPC ..... *H05H 7/18* (2013.01); *H05H 9/005* (2013.01); *H05H 9/00* (2013.01)

(58) Field of Classification Search
CPC ..... H05H 7/18; H05H 9/00; H05H 9/005
(Continued)

(56) References Cited

U.S. PATENT DOCUMENTS 2,916,710 A 12/1959 Walkinshaw et al.
5,546,743 A * 8/1996 Conner ..... H01J 45/00 315/505
(Continued)

FOREIGN PATENT DOCUMENTS

JP S63-28447 A 2/1988
JP H2-56900 A 2/1990
(Continued)

OTHER PUBLICATIONS

International Search Report in PCT/JP2016/087683, dated Feb. 14, 2017. 5pp.
(Continued)

*Primary Examiner* — Thuy V Tran
(74) *Attorney, Agent, or Firm* — Kanesaka Berner and Partners, LLP

(57) ABSTRACT

An RF accelerating cavity includes: a housing having an inner peripheral surface in a tubular shape and conductivity at least on a surface; and accelerating cells inside the housing and each made of a dielectric including, at a central part, an opening through which a charged particle passes. The housing includes a cylindrical barrel portion, with end plates at both ends. The accelerating cells are disposed
(Continued)

between the end plates. Each accelerating cell includes: a cylindrical barrel portion having a diameter smaller than an inner diameter of the cylindrical barrel portion of the housing; and a circular disk portion provided inside the cylindrical barrel portion to be fixed to the cylindrical barrel portion, and disposed such that a plate surface is orthogonal to the passing axis of a charged particle, and provided with the opening.

8 Claims, 7 Drawing Sheets

(58) Field of Classification Search
USPC ..... 315/500, 501, 505
See application file for complete search history.

(56) References Cited

U.S. PATENT DOCUMENTS 5,811,943 A * 9/1998 Mishin ..... H05H 9/04 250/396 R
8,630,689 B2 * 1/2014 Sennyu ..... H05H 7/20 505/200
2004/0108823 A1 * 6/2004 Amaldi ..... H05H 7/22 315/505
2015/0230326 A1 * 8/2015 Botto ..... G01V 5/12 378/121

FOREIGN PATENT DOCUMENTS

| | | | |
|---|---|---|---|
| JP | H9-7797 | A | 1/1997 |
| JP | H11-26194 | A | 1/1999 |
| JP | 2003-303700 | | 10/2003 |
| JP | 2007-87846 | A | 4/2007 |
| WO | 95/34192 | A1 | 12/1995 |

OTHER PUBLICATIONS

Extended European Search Report for European Application No. 16878589.7 dated Jul. 29, 2019; 7pp.

* cited by examiner

ACCELERATING CAVITY AND ACCELERATOR

RELATED APPLICATIONS

The present application is a National Phase of PCT/JP2016/087683, filed Dec. 16, 2016, and claims priority based on Japanese Patent Application No. 2015-254039, filed Dec. 25, 2015.

TECHNICAL FIELD

The present invention relates to an accelerating cavity and an accelerator.

BACKGROUND ART

In a radio-frequency (RF) accelerating cavity used for a charged particle accelerator, RF electrical power is accumulated in a metal housing, and charged particles such as electrons and ions are artificially accelerated to high speed by using RF electric field generated in the housing. Accelerators using a RF accelerating cavity are widely used in, for example, the academic fields of high-energy physics experiments and synchrotron radiation facilities and the industrial fields of radiation therapy and diagnostic devices and sterilization devices.

Typically, a RF accelerating cavity is roughly classified into a normal-conducting accelerating cavity that is made of high-purity copper and operates at room temperature, and a superconducting accelerating cavity that is made of superconductive material (for example, niobium) and operates at extremely low temperature.

PTL 1 discloses an invention related to an accelerating structure produced by alternately joining a ring-shaped acceleration member made of non-magnetic refractory metal and a ring-shaped electrical insulation member made of ceramic. PTL 2 discloses an invention related to an accelerating cavity produced by alternately connecting a basic cavity and a disk in an acceleration direction, in which the basic cavity and the disk are manufactured by forming two layers of an active silver brazing filler metal layer and a copper electroforming layer on the surface of each of a ceramic cavity and a ceramic circular disk.

CITATION LIST

Patent Literature

[PTL 1]
Japanese Unexamined Patent Application, Publication No. S63-28447
[PTL 2]
Japanese Unexamined Patent Application, Publication No. 2003-303700

SUMMARY OF INVENTION

Technical Problem

To achieve energy increase and downsizing of an accelerator in which a large number of acceleration cavities are coupled, RF accelerating cavities each having a high Q value in a low-temperature region lower than room temperature by several tens Kelvin are required when building and operation costs are taken into consideration. The Q value indicates an accumulation efficiency of RF electrical power of an accelerating cavity, and the value is largely determined by the electric conductivity of the material of the accelerating cavity. Thus, the Q value of any existing accelerating cavity made of metal is limited by the electric conductivity, which is a physical property intrinsic to metal, and thus cannot be much further increased.

For example, the Q value of an existing normal-conducting accelerating cavity can be increased by cooling accelerating cavities to low temperature. Typically, the electric conductivity of a normal conductor is significantly increased by cooling, and for example, when cooled to 20 K, the normal conductor obtains an electric conductivity $10^4$ times higher than at room temperature. However, RF electrical power is additionally lost due to a high-frequency loss mechanism called anomalous skin effect, which is different from that at room temperature. Thus, although high electric conductivity can be obtained by cooling acceleration cavities, the Q value is only increased to about 5.5 times higher than that at room temperature, for example, when the acceleration cavities are cooled to 20 K approximately, which is not significant increase.

A dielectric-loaded RF acceleration structure includes a cylindrical barrel member that is made of ceramic and an outer periphery part of which is coated with metal. The Q value of an existing dielectric-loaded RF acceleration structure exploiting a $TM_{01}$ mode is almost same as that of a normal-conducting accelerating cavity. Moreover, in a dielectric-loaded RF acceleration structure, most of RF electrical power accumulated inside a cavity is accumulated inside dielectric, and only an extremely small part of the electrical power is available for charged particle acceleration. Thus, the dielectric-loaded RF acceleration structure has extremely small shunt impedance as compared to that of any existing accelerating cavity.

The present invention is intended to solve the above-described problems by providing an accelerating cavity and an accelerator that are capable of obtaining Q values and electrical power efficiencies higher than those of a conventional normal-conducting accelerating cavity.

Solution to Problem

An accelerating cavity according to a first aspect of the present invention includes: a housing having an inner peripheral surface in a tubular shape and conductivity on a surface; and a plurality of cells provided inside the housing and each made of a dielectric including, at a central part, an opening through which a charged particle passes. The housing includes a barrel portion having a tubular shape and end plates installed at both ends of the barrel portion. The plurality of cells are disposed in a range extending from the end plate on one end side of the housing to the end plate on the other end side. Each cell includes: a cylindrical barrel portion having a diameter smaller than an inner diameter of the barrel portion of the housing; and a plate portion provided inside of the cylindrical barrel portion to be fixed to the cylindrical barrel portion, and disposed such that a plate surface is orthogonal to a passing axis of the charged particle, and provided with the opening.

With this configuration, the accelerating cavity includes the housing having the conductive surface, and the plurality of cells each made of a dielectric, in particular, a dielectric with a relatively low dielectric loss, and a charged particle is accelerated while passing through the opening provided at the central part of each cell. Electric field is generated in the direction of acceleration near the passing axis of a charged particle. The plate portion including the opening is installed inside of the cylindrical barrel portion of each cell such that the plate surface of the plate portion of the cell is orthogonal to the passing axis of a charged particle. Accordingly, the acceleration electric field can be concentrated in the direction of the passing axis of a charged particle inside of the opening of the plate portion, which leads to increase in shunt impedance. Since the cylindrical barrel portion has a diameter smaller than the inner diameter of the barrel portion of the housing, RF electrical power can be accumulated near the passing axis on which a charged particle beam passes. In addition, RF magnetic field generated in parallel to a metal surface of each end plate of the housing can be reduced, which leads to reduction of a conductor loss at the metal surface.

In the first aspect, tan δ as an index indicating a dielectric loss is equal to or smaller than $1\times10^{-3}$, more preferably $1\times10^{-5}$, for the dielectric.

In the first aspect, a cell adjacent to the end plate of the housing among the plurality of cells may further include a second cylindrical barrel portion provided around the passing axis, and the second cylindrical barrel portion may be connected with the end plate and the plate portion of the cell adjacent to the end plate.

With this configuration, the additionally provided second cylindrical barrel portion leads to further reduction of the RF magnetic field generated in parallel to the metal surface.

In the first aspect, a plurality of the cylindrical barrel portions having diameters different from each other may be concentrically disposed in each cell of the plurality of cells.

With this configuration, a high-order mode can be used as an acceleration mode, and as a result, the Q value can be further increased.

In the first aspect, the number of the plurality of cylindrical barrel portions in each cell is n−1, where n represents the order of an acceleration mode.

In the first aspect, each cell may have a surface coated with titanium nitride (TiN).

This configuration leads to reduction of the secondary electron emission coefficient of the cell in operation.

An accelerator according to a second aspect of the present invention includes the above-described accelerating cavity.

Advantageous Effects of Invention

The present invention can achieve a Q value higher than that of any conventional normal-conducting accelerating cavity, and thus achieve increased electrical power efficiency.

DESCRIPTION OF EMBODIMENTS

Embodiments of the present invention will be described below with reference to the accompanying drawings.

First Embodiment

Figure 1:
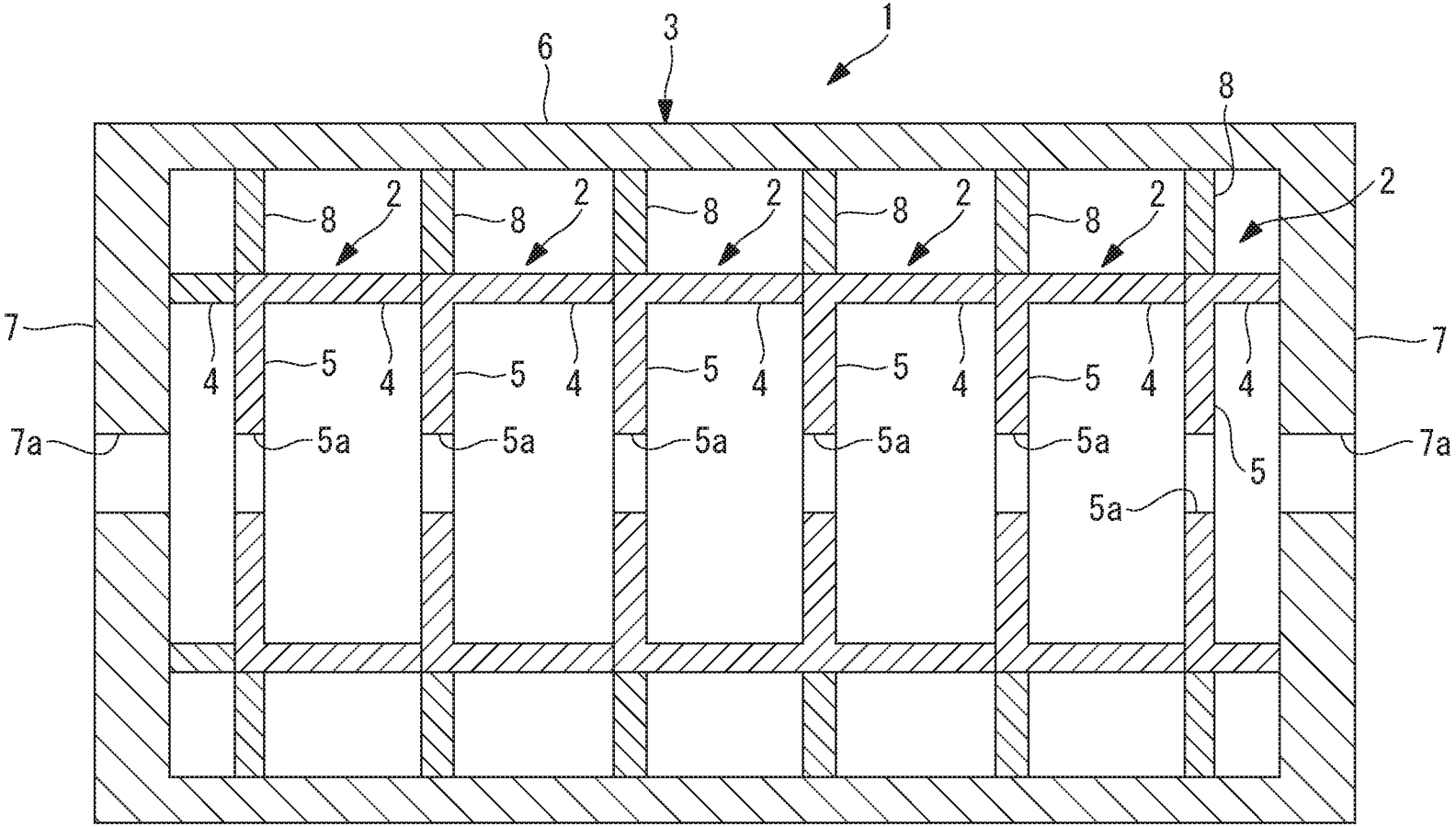
FIG. 1 is a longitudinal sectional view illustrating a RF accelerating cavity according to a first embodiment of the present invention.

The following describes an accelerator according to a first embodiment of the present invention with reference to FIG. 1. FIG. 1 is a longitudinal sectional view illustrating a RF accelerating cavity according to the first embodiment of the present invention.

This RF accelerating cavity 1 is included in the accelerator according to the present embodiment and uses, as an acceleration mode, a high-order mode such as a $TM_{0n}$ mode (n>1).

The RF accelerating cavity 1 includes, for example, a plurality of accelerating cells 2 made of a dielectric, and a cylindrical housing 3 in which the plurality of accelerating cells 2 are disposed. Charged particles pass on the central axis of the RF accelerating cavity 1.

The plurality of accelerating cells 2 are disposed in series in a beam axial direction from an end plate 7 on one side in the housing 3 to another end plate 7 on the other side. Each accelerating cell 2 includes a cylindrical barrel portion 4 and a circular disk portion 5.

To achieve convenience in manufacturing of the accelerating cell 2 and a reliable support structure, a circular ring portion 8 is provided outside of the cylindrical barrel portion 4 on a plane extending from the circular disk portion 5 provided inside of the cylindrical barrel portion 4. Accordingly, the cylindrical barrel portion 4 is connected with an integration of the circular disk portion 5 and the circular ring portion 8. The circular disk portion 5 is supported by an inner peripheral surface of the housing 3 through the circular ring portion 8.

The cylindrical barrel portion 4, the circular disk portion 5, and the circular ring portion 8 is made of a dielectric with no metal coating or the like provided on a surface. The dielectric of the accelerating cell 2, in other words, the dielectric of the cylindrical barrel portion 4 and the circular disk portion 5 has a low dielectric loss and is ceramic such as alumina or sapphire. In the present embodiment, tan δ (dielectric tangent), which is an index indicating the dielectric loss of the dielectric of the cylindrical barrel portion 4, the circular disk portion 5, and the circular ring portion 8, is $1\times10^{-3}$ or smaller, for example.

A development example of a dielectric having a low dielectric loss is ceramic (high-purity alumina) having a low dielectric loss of $7.5\times10^{-6}$ approximately at room temperature (Applied Physics Letters, (USA), 2002, Vol. 81, No. 26, pp. 5021-5023). In addition, a preceding research related to the quality of a low-loss dielectric provides an experiment result that, for example, tan δ of sapphire is proportional to temperature T [K] to the power of five, and tan $\delta=10^{-5}$ at room temperature decreases to tan $\delta=10^{-7}$ at 80 K (Physics Letters A, (Holland), 1987, Vol. 120, No. 6, pp. 300-305).

The housing 3 includes a cylindrical barrel portion 6, and the circular plate end plates 7 provided at both side ends of the cylindrical barrel portion 6. The housing 3 is made of, for example, a highly conductive metallic material that is pure metal such as oxygen-free copper or stainless steel plated with silver or copper. Alternatively, the housing 3 may be made of a dielectric such as ceramic plated with silver or copper as appropriate. The use of such metal material or metal-plated dielectric provides conductivity at the surface of the housing 3. Each end plate 7 is a plate member provided with a circular opening 7*a* at the center.

The cylindrical barrel portion 4 of each accelerating cell 2 has a central axis aligned with the central axis of the cylindrical barrel portion 6 of the housing 3, and has a diameter smaller than that of the cylindrical barrel portion 6 of the housing 3. The diameter of the cylindrical barrel portion 4 may be identical in all accelerating cells 2 or may be different among the accelerating cells 2. For example, the diameter of the cylindrical barrel portion 4 may be set to be larger on an end part side than on a middle part side. The circular disk portion 5 is connected with an end part of the cylindrical barrel portion 4.

The circular disk portion 5 of each accelerating cell 2 is a plate member provided with a circular opening 5*a* at the center. The opening 5*a* has a diameter smaller than that of the cylindrical barrel portion 4. Charged particles pass through the opening 5*a*. The cylindrical barrel portion 4 is installed orthogonal to the plane of the circular disk portion 5. The circular disk portion 5 is disposed at a position separated from each end plate 7 of the housing 3, and the cylindrical barrel portion 4 contacts with the end plate 7. Not every accelerating cell 2 includes the cylindrical barrel portion 4 and the circular disk portion 5, but only the cylindrical barrel portion 4 or the circular disk portion 5 may be included in some accelerating cells 2.

The above-described configuration generates electric field in the direction of acceleration near the beam axis. The circular disk portion 5 including the opening 5*a* is installed inside of the cylindrical barrel portion 4 such that a plate surface of the circular disk portion 5 of each accelerating cell 2 is orthogonal to the beam axis. Accordingly, the acceleration electric field can be concentrated in the beam axial direction inside of the opening 5*a* of the circular disk portion 5, which leads to increase in shunt impedance.

Electromagnetic field distribution in an acceleration mode excited inside the RF accelerating cavity 1 is adjusted by adjusting, for example, the inner and outer diameters of the cylindrical barrel portion 4 of each accelerating cell 2 disposed in the housing 3, intervals between the circular disk portions 5, the inner diameter of the opening 5*a* of each circular disk portion 5, and the inner diameter of the housing 3. The cylindrical barrel portion 4 allows accumulation of RF electrical power near the beam axis on which a charged particle beam passes. As a result, RF magnetic field generated in parallel to a metal surface of each end plate 7 of the housing 3 can be reduced, which leads to reduction of a conductor loss at the metal surface.

Figure 2:
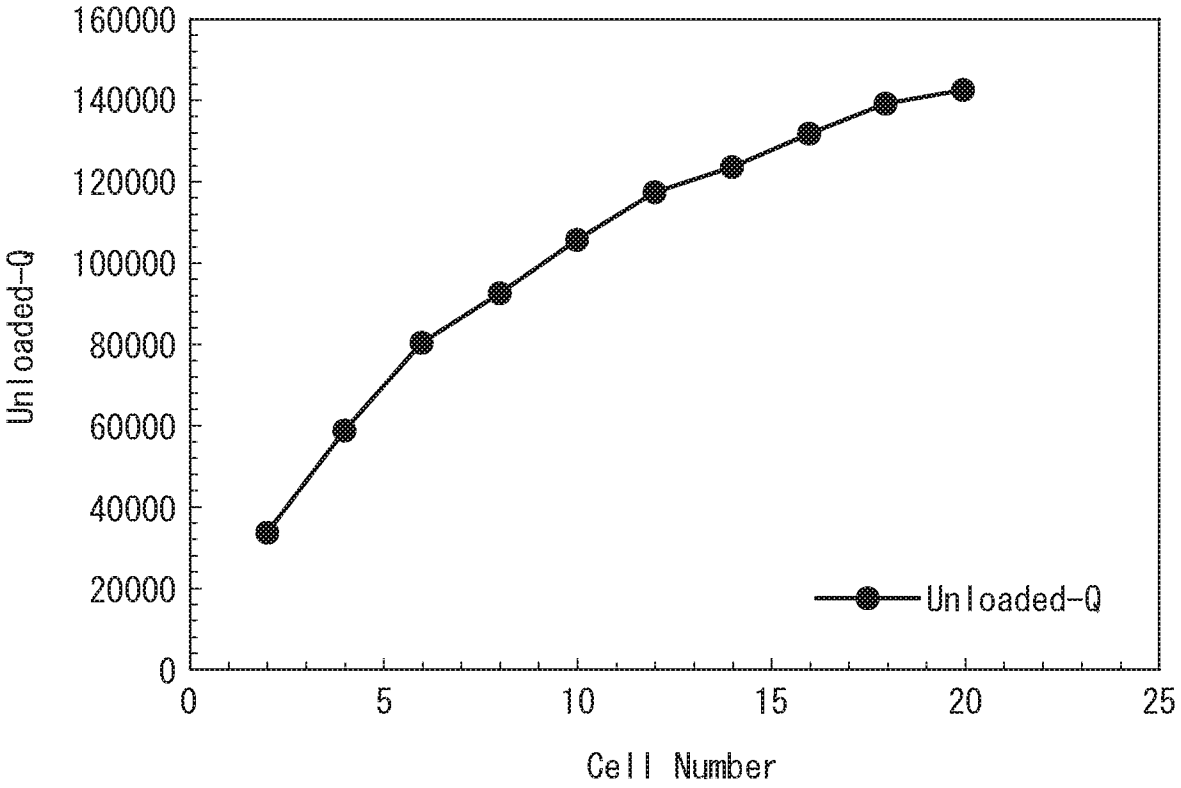
FIG. 2 is a graph illustrating the relation between the number of accelerating cells and the unloaded Q value of the RF accelerating cavity.

For example, in a case of a five-cell structure including five accelerating cells 2, the Q value is 60,000 approximately as illustrated in FIG. 2, which is at least several times higher than that for a conventional normal-conducting accelerating cavity. When made of copper, the conventional normal-conducting accelerating cavity has a Q value of 10,000 approximately. FIG. 2 indicates that the Q value tends to become higher as the number of cells increases. This is because, as the number of cells increases, the RF accelerating cavity 1 is longer, and the ratio of an energy lose in the RF accelerating cavity 1 decreases.

Calculation that derived the result of the Q value illustrated in FIG. 2 was performed by a calculation program (Poisson Superfish: Los Alamos national laboratory (http://laacg.lanl.gov/laacg/services/download_sf.phtml)).

The calculation was performed under conditions as follows: the physical properties of high-purity alumina (Applied Physics Letters, (USA), 2002, Vol. 81, No. 26, pp. 5021-5023) described above were used for the dielectric of the cylindrical barrel portion 4 and the circular disk portion 5 of each accelerating cell 2, and the physical properties of oxygen-free copper were used for the metal of the housing 3. The structure of the RF accelerating cavity 1 was simulated by changing the inner and outer diameters of the cylindrical barrel portion 4 of the accelerating cell 2 and the inner diameter of the housing 3 so that electromagnetic field distribution in a n mode at a predetermined resonance frequency is excited in the RF accelerating cavity 1. The inner and outer diameters of the cylindrical barrel portion 4 and the inner diameter of the housing 3 were calculated from a result of the simulation. Then, the Q value was calculated by using the calculated structure. The n mode refers to a mode in which resonance electric fields having phases shifted from each other by 180° are alternately generated in vacuum parts each sandwiched between the circular disk portions 5 and including the beam axis.

The Q value is given by an expression below.

$$Q=(2\pi f\cdot U)/(P_\mathrm{loss})$$

In the expression, U represents the energy of electromagnetic wave accumulated in the RF accelerating cavity 1, P_loss represents an energy loss of electromagnetic wave in the RF accelerating cavity 1 (per one period of electromagnetic wave), and f represents the frequency of electromagnetic wave.

Figure 7:
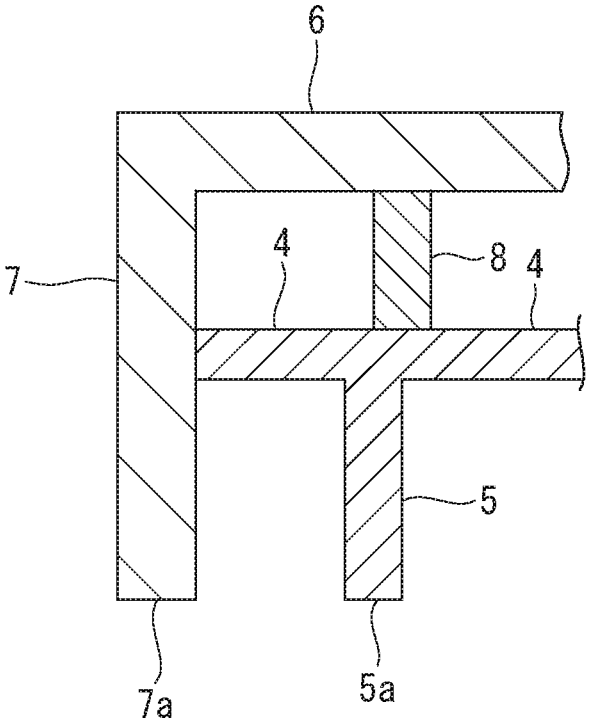
FIG. 7 is a partially longitudinal sectional view illustrating the RF accelerating cavity according to a modification of the first embodiment of the present invention.

In the above-described example, the circular ring portion 8 is provided on the extending plane of the plate surface of the circular disk portion 5, but the present invention is not limited to this example. Specifically, the circular ring portions 8 do not need to be provided for the respective circular disk portions 5, but may be provided in a number smaller than the number of circular disk portions 5 or may be each provided at a position shifted from the extending plane of the circular disk portion 5 as illustrated in FIG. 7, not on the extending plane of the circular disk portion 5. In other words, the circular ring portions 8 only need to be disposed between the inner peripheral surface of the housing 3 and the outer peripheral surface of the cylindrical barrel portion 4 to support the cylindrical barrel portions 4 and the circular disk portions 5.

According to the present embodiment described above, the Q value at least five times higher than that of an existing normal-conducting accelerating cavity at room temperature can be obtained, thereby achieving a RF accelerator having an electrical power efficiency higher than conventional cases.

Second Embodiment

Figure 3:
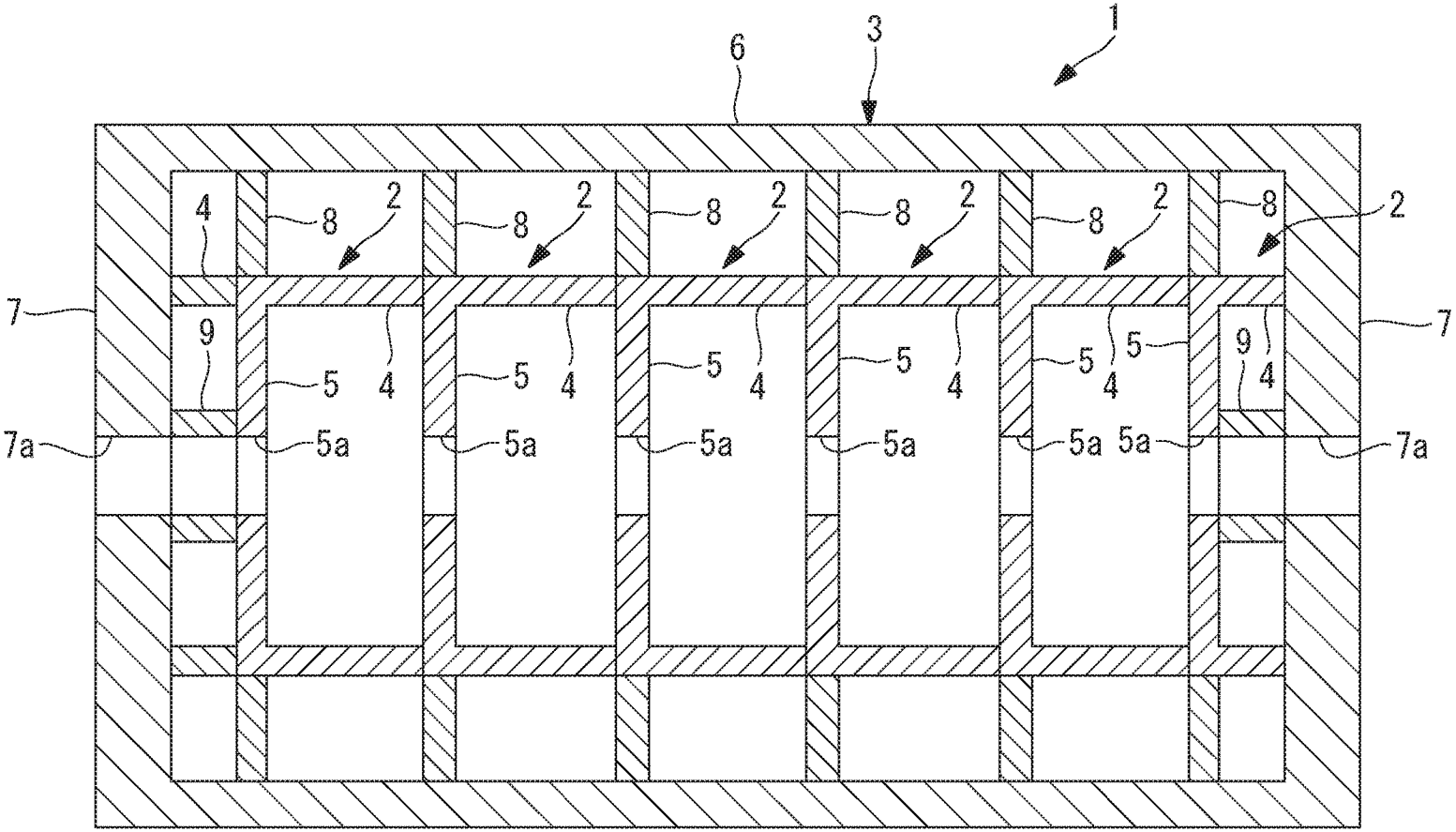
FIG. 3 is a longitudinal sectional view illustrating the RF accelerating cavity according to a second embodiment of the present invention.

The following describes the RF accelerating cavity 1 according to a second embodiment of the present invention with reference to FIG. 3. In the RF accelerating cavity 1 according to the present embodiment, a cylindrical barrel portion 9 is provided around the beam axis in the accelerating cell 2 adjacent to each end plate 7 of the housing 3 among the accelerating cells 2. The cylindrical barrel portion 9 is provided to the accelerating cell 2 close to the end plate 7 on each side. The cylindrical barrel portion 9 has an inner diameter equal to that of the opening 5*a* of the circular disk portion 5, and has one end part connected with the corresponding end plate 7 of the housing 3 and the other end part connected with the circular disk portion 5 of the corresponding accelerating cell 2.

The cylindrical barrel portion 9 is made of a dielectric same as those of the cylindrical barrel portion 4, the circular disk portion 5, and the circular ring portion 8 described in the first embodiment.

In the first embodiment, the RF magnetic field generated in parallel to the metal surface is reduced at each end plate 7 of the housing 3 of the RF accelerating cavity 1. In the present embodiment, the additionally provided cylindrical barrel portion 9 leads to further reduction of the RF magnetic field generated in parallel to the metal surface.

A calculation result of the Q value by the above-described calculation program based on the structure of the RF accelerating cavity 1 according to the second embodiment shows that the Q value is 100,000 or higher in a case of the five-cell structure. Thus, the structure of the RF accelerating cavity 1 according to the present embodiment can achieve the Q value about two times higher than that of the structure of the RF accelerating cavity 1 according to the first embodiment in which the cylindrical barrel portion 9 is not installed. Accordingly, a RF accelerator having an electrical power efficiency higher than conventional cases can be achieved.

Third Embodiment

Figure 4:
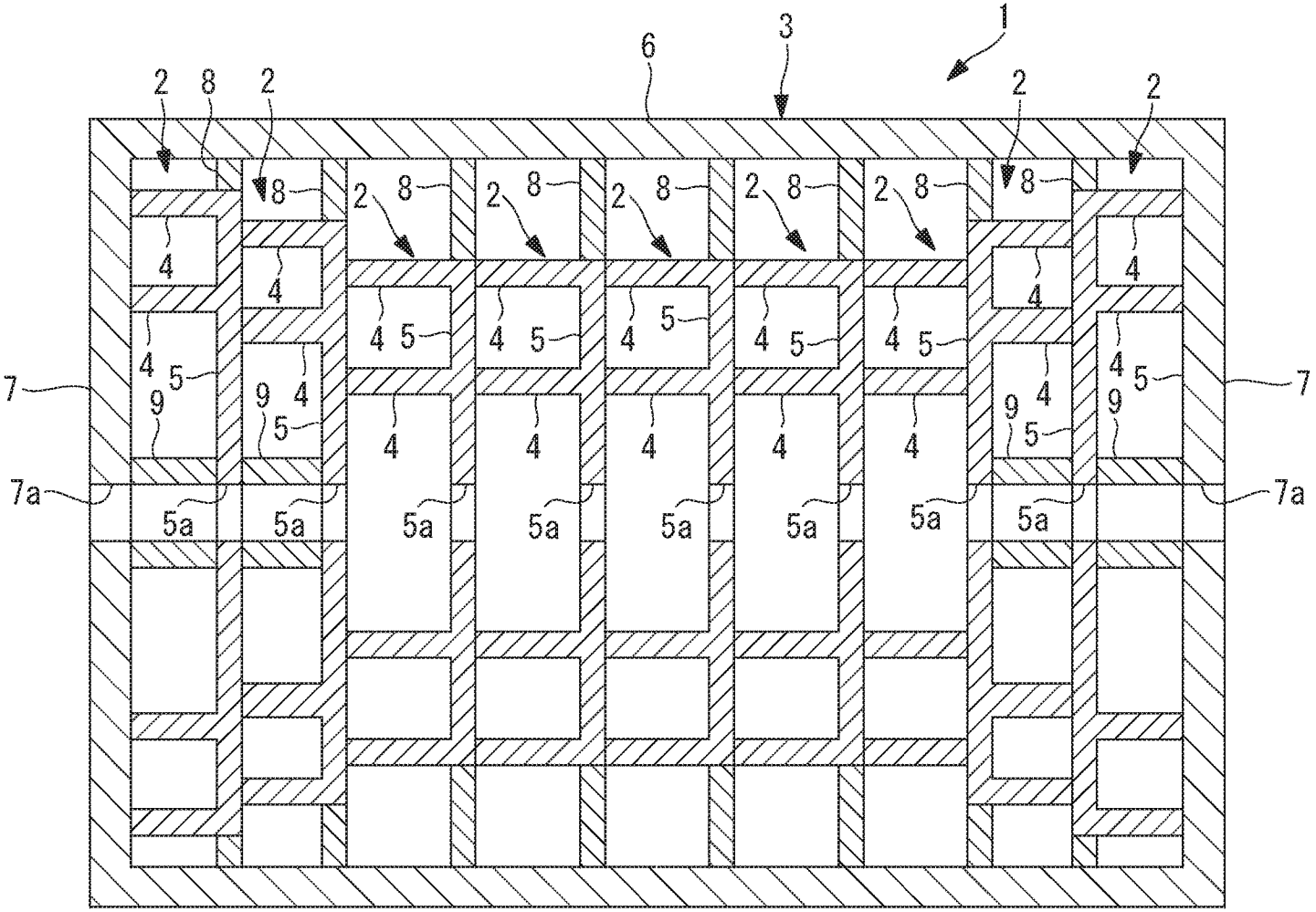
FIG. 4 is a longitudinal sectional view illustrating the RF accelerating cavity according to a third embodiment of the present invention.

The following describes the RF accelerating cavity 1 according to a third embodiment of the present invention with reference to FIG. 4. In the RF accelerating cavity 1 according to the present embodiment, a plurality of cylindrical barrel portions 4 having diameters different from each other are concentrically provided in each accelerating cell 2. With this configuration, the RF accelerating cavity 1 can use a high-order mode as an acceleration mode. As a result, the Q value can be further increased.

In the first embodiment, only one cylindrical barrel portion 4 is provided in each accelerating cell 2, but the present invention is not limited to this example. Two or more cylindrical barrel portions 4 may be provided. FIG. 4 illustrates an example in which two cylindrical barrel portions 4 are provided.

When two or more cylindrical barrel portions 4 are provided, the cylindrical barrel portions 4 have central axes aligned on an identical axis and are concentrically installed in each accelerating cell 2. The number of the cylindrical barrel portions 4 is n−1, where n represents the order of the acceleration mode of the RF accelerating cavity. Specifically, one cylindrical barrel portion 4 is provided when the acceleration mode order is two, and two cylindrical barrel portions 4 are provided when the acceleration mode order is three.

In the example illustrated in FIG. 4, similarly to the second embodiment, the cylindrical barrel portion 9 is installed around the beam axis in the accelerating cell 2 close to each end plate 7 of the housing 3 among the accelerating cells 2. The cylindrical barrel portions 9 are provided to the n−1 accelerating cells 2 on each end side, where n represents the order of the acceleration mode of the RF accelerating cavity. For example, when the two cylindrical barrel portions 4 are provided and the order of the acceleration mode is three, the cylindrical barrel portions 9 are installed in the two accelerating cells 2 closest to each end plate 7 of the housing 3.

In the present embodiment, similarly to the second embodiment, the cylindrical barrel portions 9 are provided to the accelerating cells 2 close to the end plates 7 of the housing 3. However, no cylindrical barrel portion 9 may be provided in the RF accelerating cavity 1 that employs any high-order mode as the acceleration mode, similarly to the first embodiment.

Example 1

Figure 5:
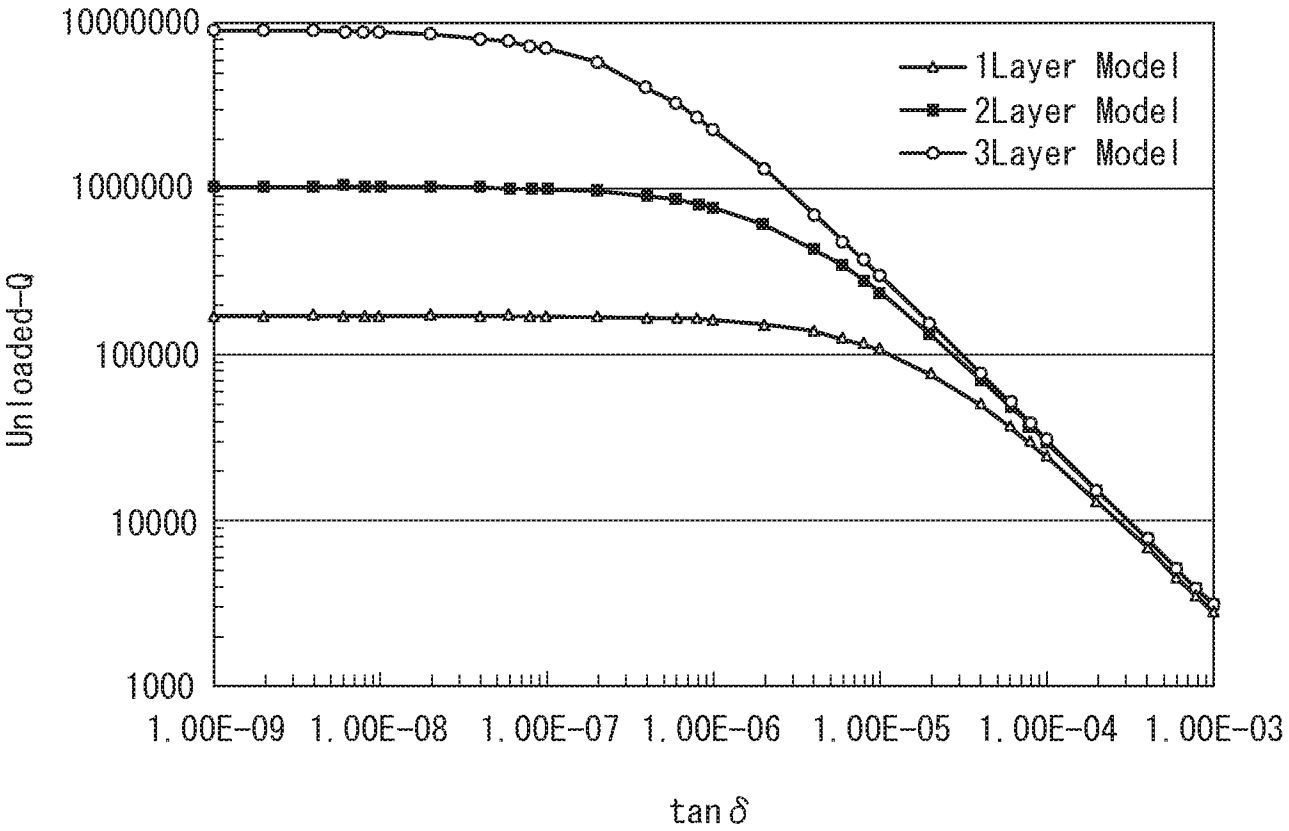
FIG. 5 is a graph illustrating the relation between tan δ as an index indicating the dielectric loss of a dielectric and the unloaded Q value of the RF accelerating cavity.

FIG. 5 illustrates a calculation result of the unloaded Q value when tan δ as an index illustrating the dielectric loss of the dielectric used for the accelerating cells 2 is changed in each case in which the number of provided cylindrical barrel portions 4 is one, two, or three. In this calculation, the surface resistance of copper is a value at room temperature.

The result illustrated in FIG. 5 indicates that the unloaded Q value increases with increase in the number of dielectric cylindrical barrel portions 4 in each accelerating cell 2.

Specifically, increase in the number of cylindrical barrel portions 4 can reduce electric field generated at the conductive surface of the housing 3 at a high-order mode. This leads to reduction of an energy loss, thereby increasing the Q value. Accordingly, the acceleration electric field can be concentrated in the beam axial direction.

Example 2

Figure 6:
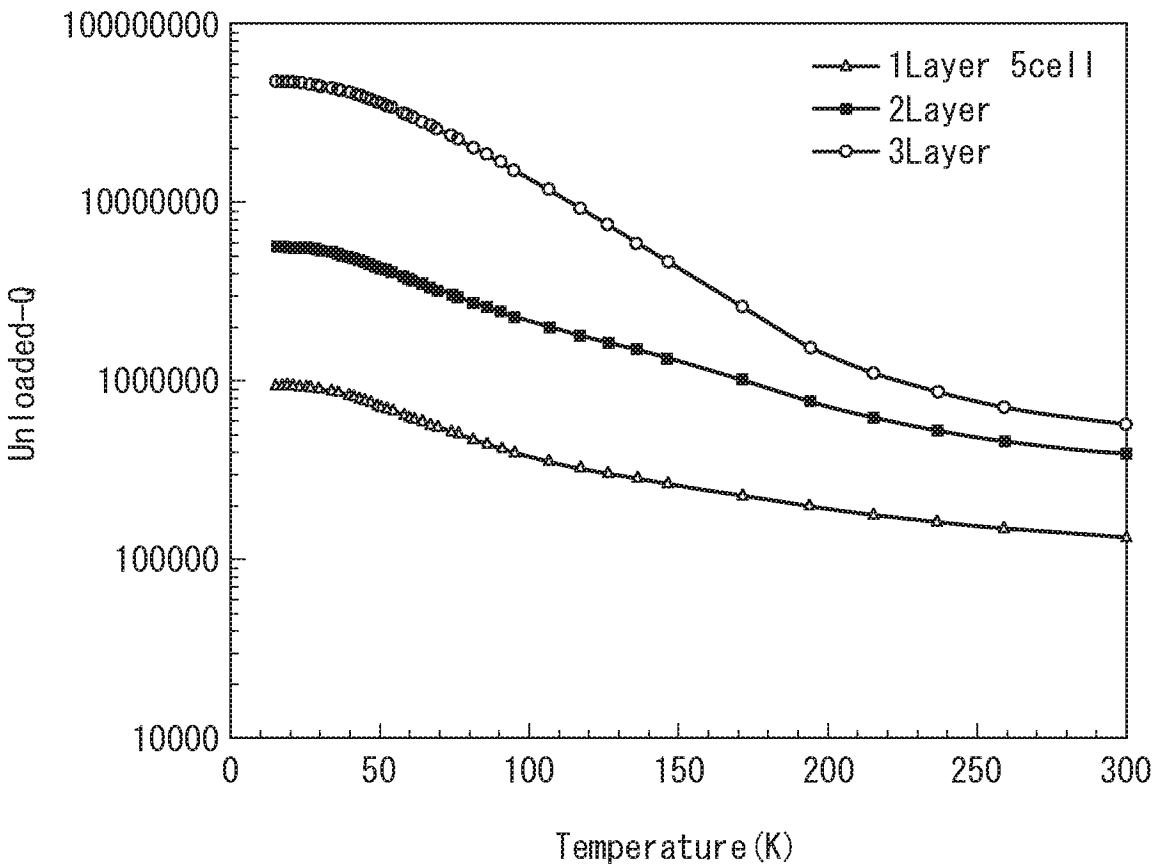
FIG. 6 is a graph illustrating the relation between tan δ as an index indicating the dielectric loss of a dielectric and the temperature.

FIG. 6 illustrates a calculation result of the unloaded Q value when the temperature of environment in which the RF accelerating cavity 1 is used is changed in each case in which the number of provided cylindrical barrel portions 4 is one, two, or three. The calculation obtains the unloaded Q value for a case in which high-purity copper having a residual resistance ratio (RRR) of 2000 or higher is used as the metal of the housing 3, and the entire RF accelerating cavity 1 is cooled to liquid nitrogen temperature.

The calculation result indicates that the Q value and shunt impedance of the RF accelerating cavity 1 can be improved by cooling the entire RF accelerating cavity 1. Specifically, when the entire RF accelerating cavity 1 is cooled, the temperature of the housing 3 decreases and electric resistance decreases accordingly, which leads to reduction of an energy loss in the housing 3. FIG. 6 indicates that the unloaded Q value increases as the temperature decreases when the number of provided cylindrical barrel portions 4 is any of one, two, and three, and that the increase of the Q value is larger as the number of layers of cylindrical barrel portions 4 increases.

In a three-layer structure in which the number of provided cylindrical barrel portions 4 is three, the cooling to liquid nitrogen temperature can lead to the Q value about 100 times higher than a case with room temperature, thereby achieving high shunt impedance.

In the above-described first to third embodiments, no metal coating is provided to the dielectric in the cylindrical barrel portion 4, the circular disk portion 5, and the circular ring portion 8 of each accelerating cell 2 in the RF accelerating cavity 1. However, the cylindrical barrel portion 4, the circular disk portion 5, and the circular ring portion 8 may be provided with metal coating.

Metal coating is, for example, coating with TiN, and provided in a thickness of several nanometers approximately. The TiN coating provided on the surface of the dielectric leads to reduction of the secondary electron emission coefficient of each accelerating cell 2 when an accelerator is operational in a known case (Yuko Kijima et al., "the secondary electron emission coefficient of the material for the superconducting cavity input coupler", vacuum, the vacuum society of Japan, 2002, Vol. 45, 7, pp. 599-603) in which the dielectric is alumina, the secondary electron emission coefficient, which is 4.8 for HA95 (purity at 95%) and 6.5 for HA997 (purity at 99.7%), can be decreased to two or lower by the TiN coating. The secondary electron emission coefficient equal to two or lower is substantially same as that of an existing normal-conducting accelerating cavity.

The decrease of the secondary electron emission coefficient reduces the probability of electrical discharging due to the multifactor effect at a ceramic surface when high electric field is applied to the RF accelerating cavity 1, thereby achieving more stable operation.

REFERENCE SIGNS LIST

1 RF accelerating cavity
2 accelerating cell
3 housing
4 cylindrical barrel portion
5 circular disk portion
6 cylindrical barrel portion
7 end plate
8 circular ring portion
9 cylindrical barrel portion

The invention claimed is:

1. An accelerating cavity comprising:

a housing having an inner peripheral surface in a tubular shape and conductivity on a surface; and a plurality of cells provided inside the housing and each made of a dielectric including, at a central part, an opening through which a charged particle passes, wherein the housing includes a barrel portion having a tubular shape and end plates installed at both ends of the barrel portion, the plurality of cells are disposed in a range extending from the end plate on one end side of the housing to the end plate on the other end side, and each cell includes:

a cylindrical barrel portion having a diameter smaller than an inner diameter of the barrel portion of the housing; and a plate portion provided inside of the cylindrical barrel portion to be fixed to the cylindrical barrel portion, and disposed such that a plate surface is orthogonal to a passing axis of the charged particle, and provided with the opening.

2. The accelerating cavity according to claim 1, wherein an index tan δ indicating a dielectric loss is equal to or smaller than 1×10−3 for the dielectric.

3. The accelerating cavity according to claim 1, wherein an index tan δ indicating a dielectric loss is equal to or smaller than 1×10−5 for the dielectric.

4. The accelerating cavity according to claim 1, wherein a cell adjacent to the end plate of the housing among the plurality of cells further includes a second cylindrical barrel portion provided around the passing axis, and the second cylindrical barrel portion is connected with the end plate and the plate portion of the cell adjacent to the end plate.

5. The accelerating cavity according to claim 1, wherein the plurality of the cylindrical barrel portions having diameters different from each other are concentrically disposed in each cell of the plurality of cells.

6. The accelerating cavity according to claim 5, wherein the number of the plurality of cylindrical barrel portions in each cell is n−1, where n represents the order of an acceleration mode.

7. The accelerating cavity according to claim 1, wherein each cell has a surface coated with TiN.

8. An accelerator comprising:

an accelerating cavity, wherein, the accelerating cavity comprises;

a housing having an inner peripheral surface in a tubular shape and conductivity on a surface; and a plurality of cells provided inside the housing and each made of a dielectric including, at a central part, an opening through which a charged particle passes, wherein the housing includes a barrel portion having a tubular shape and end plates installed at both ends of the barrel portion, the plurality of cells are disposed in a range extending from the end plate on one end side of the housing to the end plate on the other end side, and each cell includes:

a cylindrical barrel portion having a diameter smaller than an inner diameter of the barrel portion of the housing; and a plate portion provided inside of the cylindrical barrel portion to be fixed to the cylindrical barrel portion, and disposed such that a plate surface is orthogonal to a passing axis of the charged particle, and provided with the opening.

* * * * *